US007704159B1

(12) United States Patent
McDonald

(10) Patent No.: US 7,704,159 B1
(45) Date of Patent: Apr. 27, 2010

(54) INTERCHANGEABLE GOLF CLUB SYSTEM

(76) Inventor: Mark McDonald, 2121 Windflower Dr., Norwalk, IA (US) 50211

( * ) Notice: Subject to any disclaimer, the term of this patent is extended or adjusted under 35 U.S.C. 154(b) by 0 days.

(21) Appl. No.: 12/114,221

(22) Filed: May 2, 2008

Related U.S. Application Data

(63) Continuation-in-part of application No. 11/509,353, filed on Aug. 24, 2006, now abandoned.

(51) Int. Cl.
*A63B 53/10* (2006.01)
*A63B 53/12* (2006.01)

(52) U.S. Cl. ..... 473/296

(58) Field of Classification Search ..... 473/298–299, 473/239, 296; 279/67, 112, 123, 147; 403/109.1
See application file for complete search history.

(56) References Cited

U.S. PATENT DOCUMENTS

| | | | |
|---|---|---|---|
| 3,102,726 | A | 9/1963 | Barrett |
| 4,340,227 | A | 7/1982 | Dopkowski |
| 4,852,782 | A | 8/1989 | Wu et al. |
| 5,569,096 | A | 10/1996 | Lee |
| 5,722,901 | A | 3/1998 | Barron et al. |
| 6,547,673 | B2 | 4/2003 | Roark |
| 7,074,135 | B2 | 7/2006 | Moore |
| 2004/0116197 | A1 | 6/2004 | Benson |

*Primary Examiner*—Stephen L. Blau
(74) *Attorney, Agent, or Firm*—Lawrence J. Gibney, Jr.

(57) ABSTRACT

This is an interchangeable golf club system, which allows particular golf club heads to be interchanged on the shaft of a golf club. Additionally, the length of the golf club can be adjusted using this same device. A set of locking rings allow appropriate adjustment of the length of the club or the replacement of the golf club head are provided.

3 Claims, 7 Drawing Sheets

INTERCHANGEABLE GOLF CLUB SYSTEM

STATEMENT CONCERNING RELATED APPLICATIONS

This is a continuation in part of the application with Ser. No. 11/509,353 and a filing date of Aug. 24, 2006 now abandoned.

BACKGROUND OF THE INVENTION

A. Field of the Invention

This is related to golfing and, in particular, being able to change the golf club head on a given shaft and being able to adjust the length of the club.

B. Prior Art

There are many other prior art references related to golfing in general. There are other references related to changing golf club heads and lengths of clubs. A representative example of this type of device is found at Lee, U.S. Pat. No. 5,569,096. Lee is a golf club putter, having an adjustable shaft length. This does not, however, enable the individual to remove the putter head but only to lengthen the shaft. Another example in the prior art can be found at Benson, U.S. Patent Publication 2004/0116197. Benson discusses an extensible golf club, which again extends the length of the club but does not affect the type of club that will be used or allow for the golf club head to be changed.

Another example in the prior art, which teaches a changeable golf club head can be found at Roark, U.S. Pat. No. 6,547,673, which is an interchangeable golf club head.

The system in Roark will allow the user to change a golf club head; however, it does not anticipate using a chuck system and instead uses an interlocking/coupling type of mechanism, which is substantially different than the present system. The current system also does not modify the golf club externally.

BRIEF SUMMARY OF THE INVENTION

In the game of golf, it is sometimes necessary and oftentimes desirable to change the length of a golf club. This may be due to a particular user's golf swing or the height of an individual using the club. This may be particularly true if the clubs are rented.

Rather than incur the expense of buying a specific set of clubs for a specific person, this device allows a specific club head or a set of clubs to be used interchangeably. All golf club heads can be changed, including putters, irons and woods.

Additionally, the length of the club can also be adjusted to fit the specific parameters of a person's body type, height and also the form of the person's swing.

It is an object of this device to allow an individual to change the golf club head as well as adjust the length of a golf club shaft.

NUMBERING REFERENCES

Figure 1:
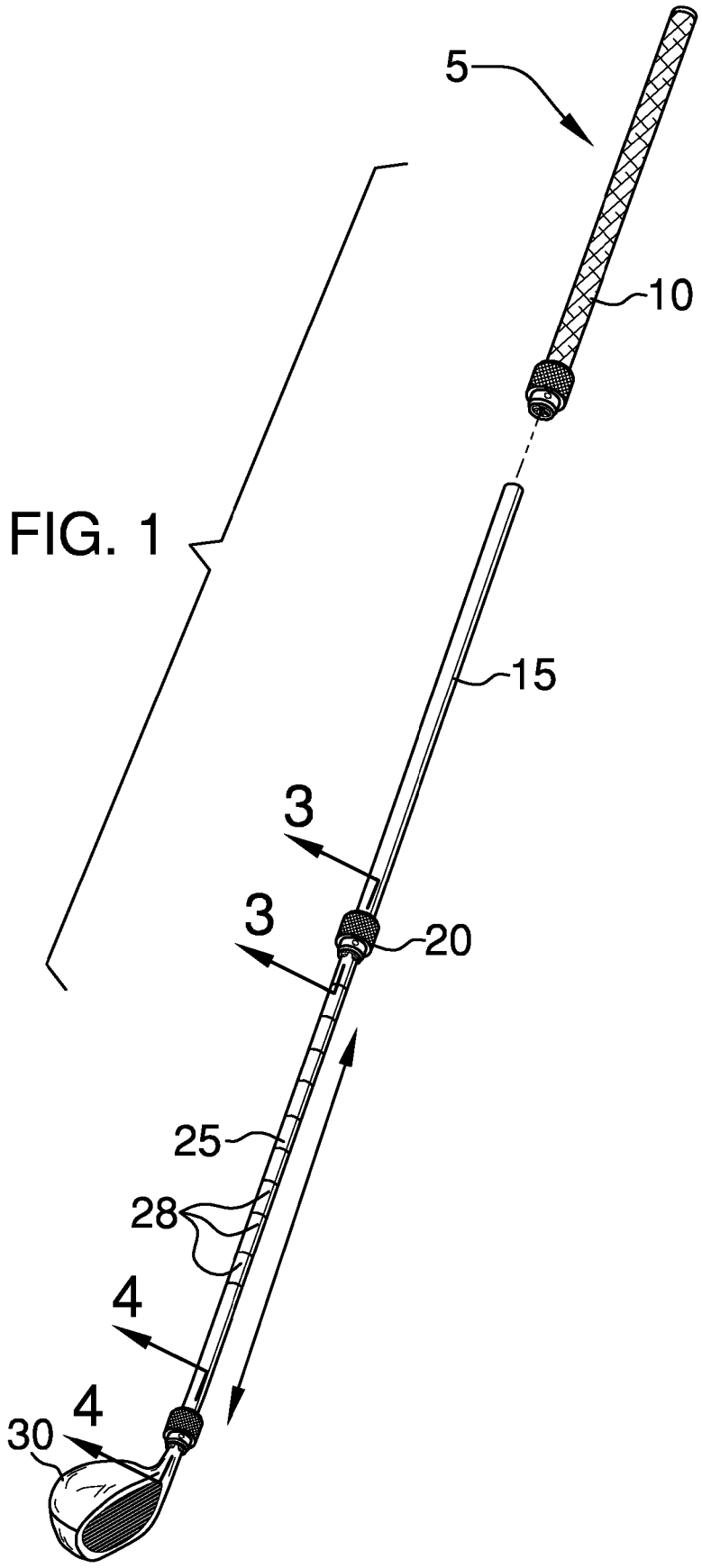
FIG. 1 is an isometric view of the device with a driver head attached.

5. Device
10. Grip
11. Grip shaft
15. Exterior outer shaft
16. Inner telescoping shaft
20. Locking mechanism
20A. Outer locking shell
20B. Inner locking shell
20T. Threaded portion of outer locking means
25. Exposed portion of inner telescoping shaft
26. Jaw
26T. Threaded portion on jaw
27. Chuck key
28. Key hole to tighten chuck
29. Club head shaft
30. Club head (Driver)
31. Lower shaft stop
32. Upper shaft stop
33. Teeth
34. Club head (Putter)
35. Seal
36. Club head (Iron)
38. Club head (Wedge)
39. Spring
40. Protuberance on outer locking shell
41. Groove in shaft
43. Inner Locking Shell Protuberance
44. Groove on outer locking means

DETAILED DESCRIPTION OF THE EMBODIMENTS

Figure 2:
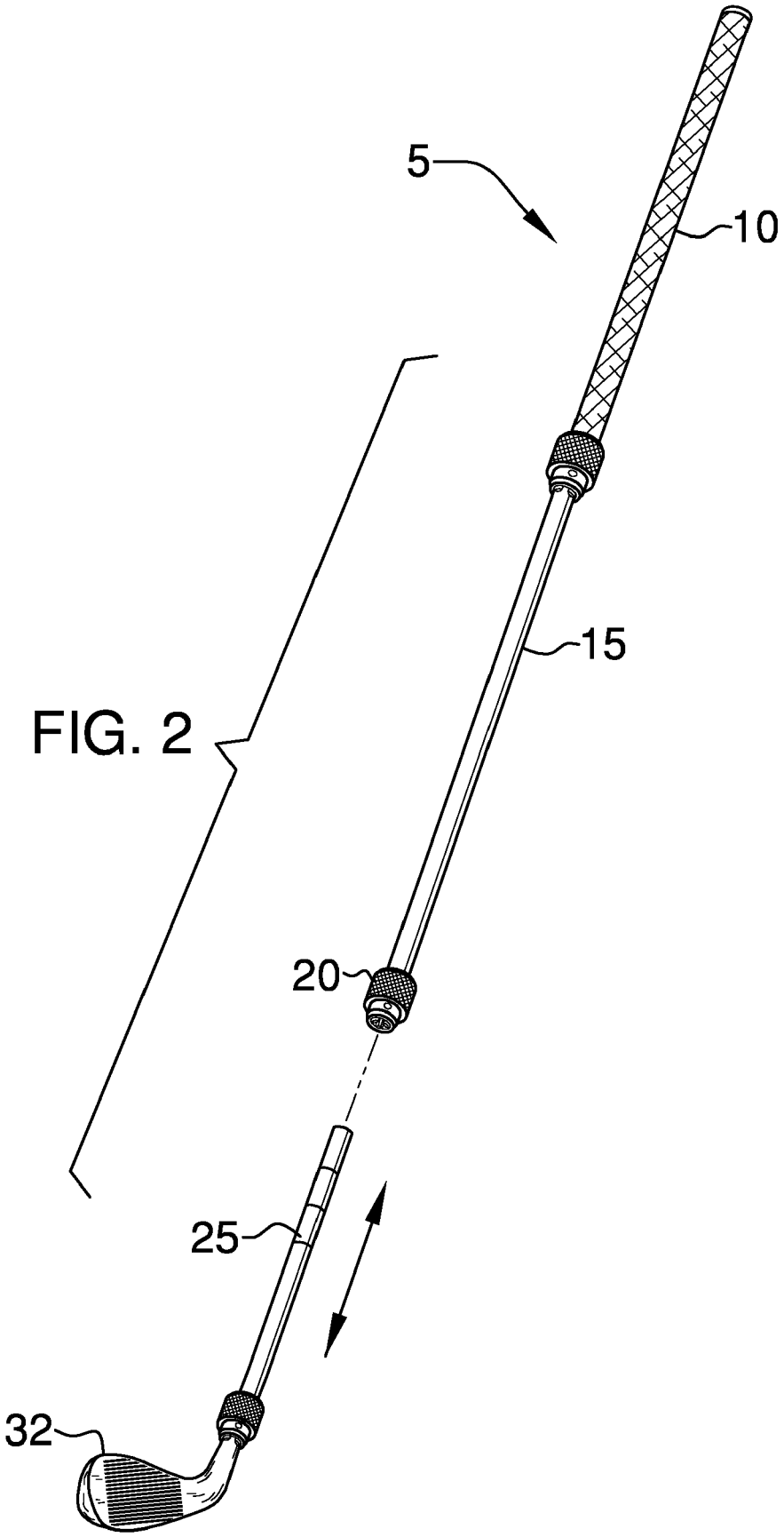
FIG. 2 is an isometric view of the device with an iron head attached and the length shortened.

The device 5 has the look of a standard golf club, including a grip 10, an exterior outer shaft 15, and a golf club head 30. Various golf club heads are used with this device, and any golf club head may be used with this device. FIG. 1 depicts the device with the grip 10 detached and a driver attached as the club head 30. FIG. 2 is an isometric view of the device with the handle shortened, and a three iron 32 as the detachable club head.

Figure 3:
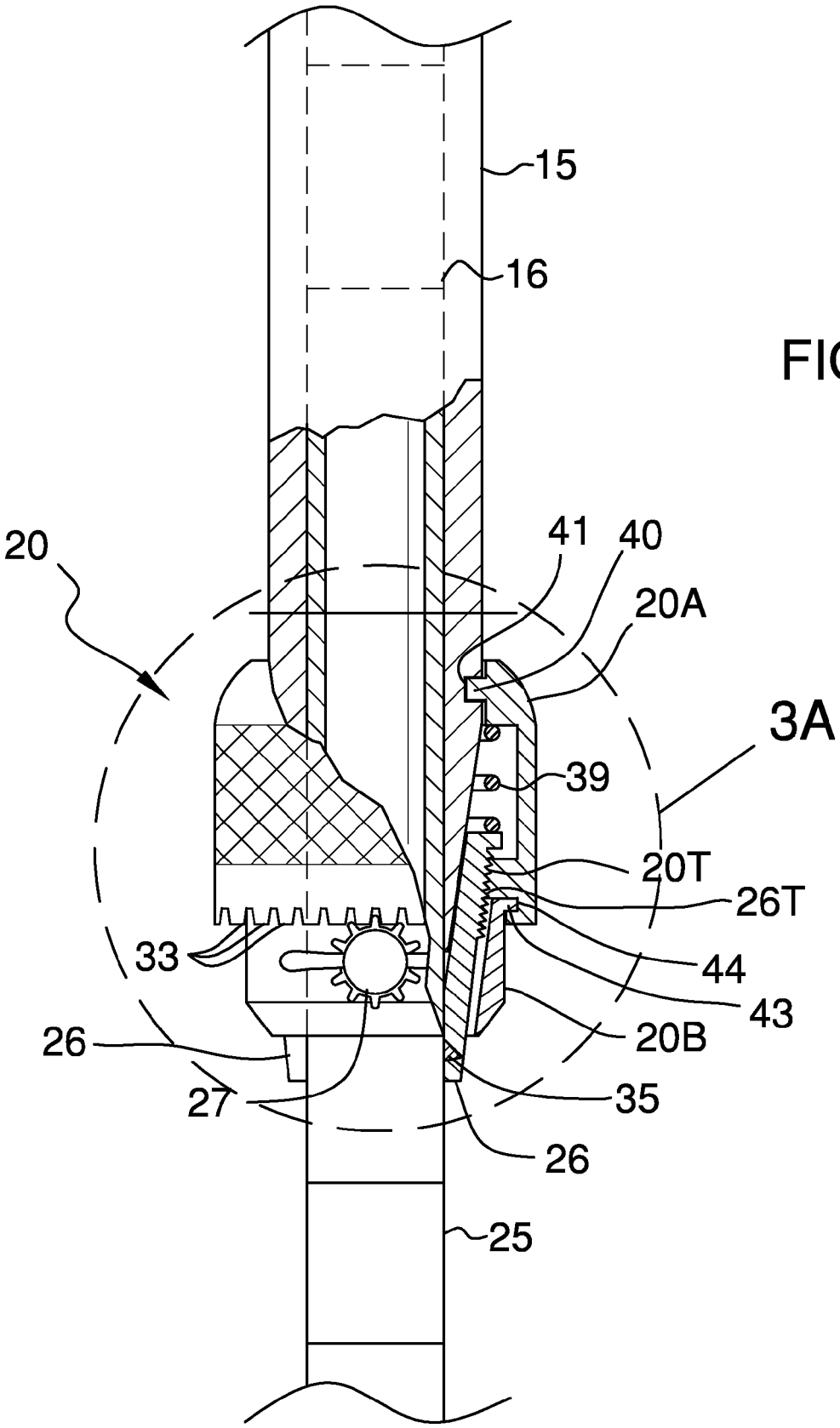
FIG. 3 is a view according to line 3-3 on FIG. 1.
Figure 3A:
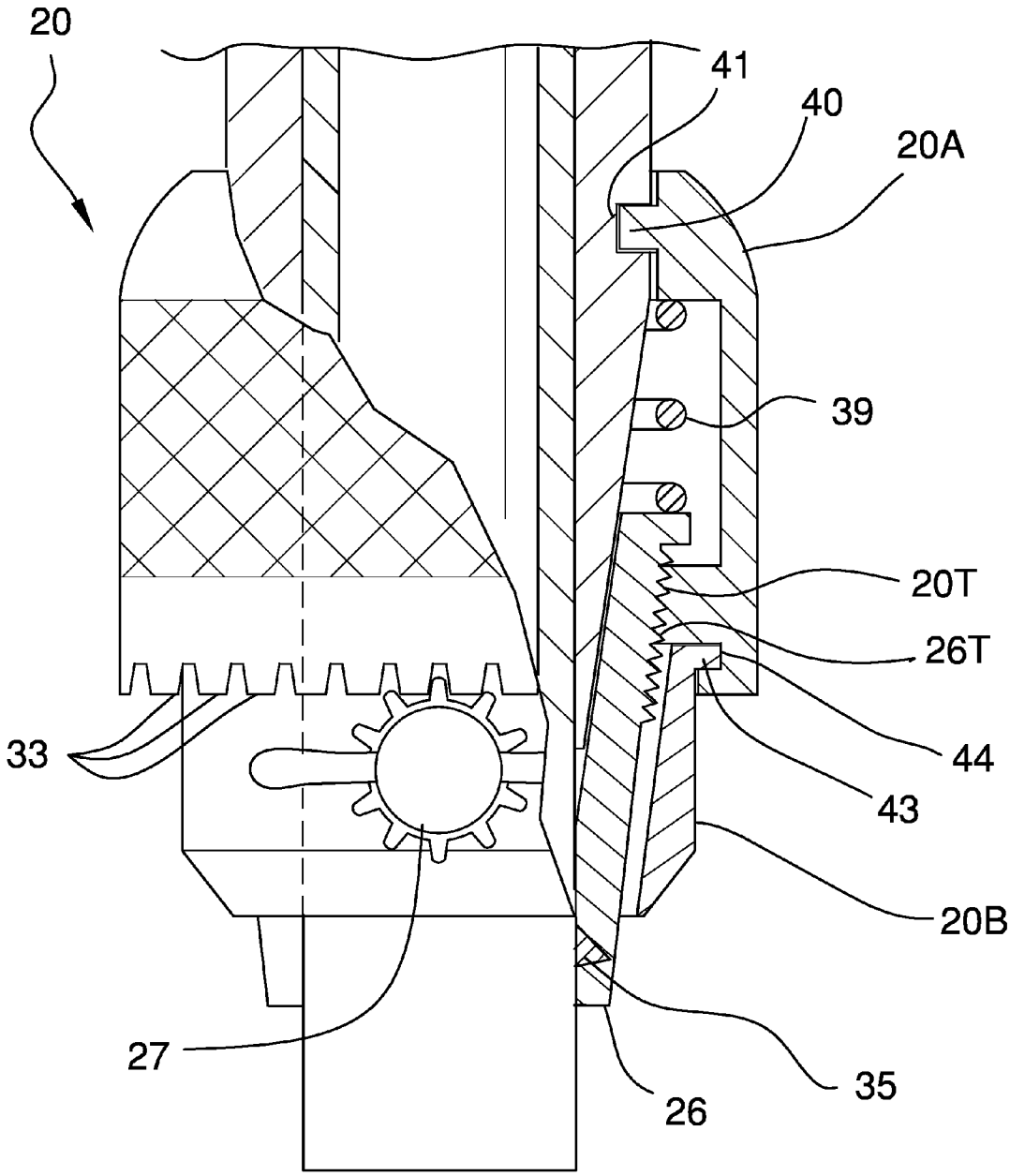
FIG. 3A is an enlarged view of the locking ring assembly.
Figure 4:
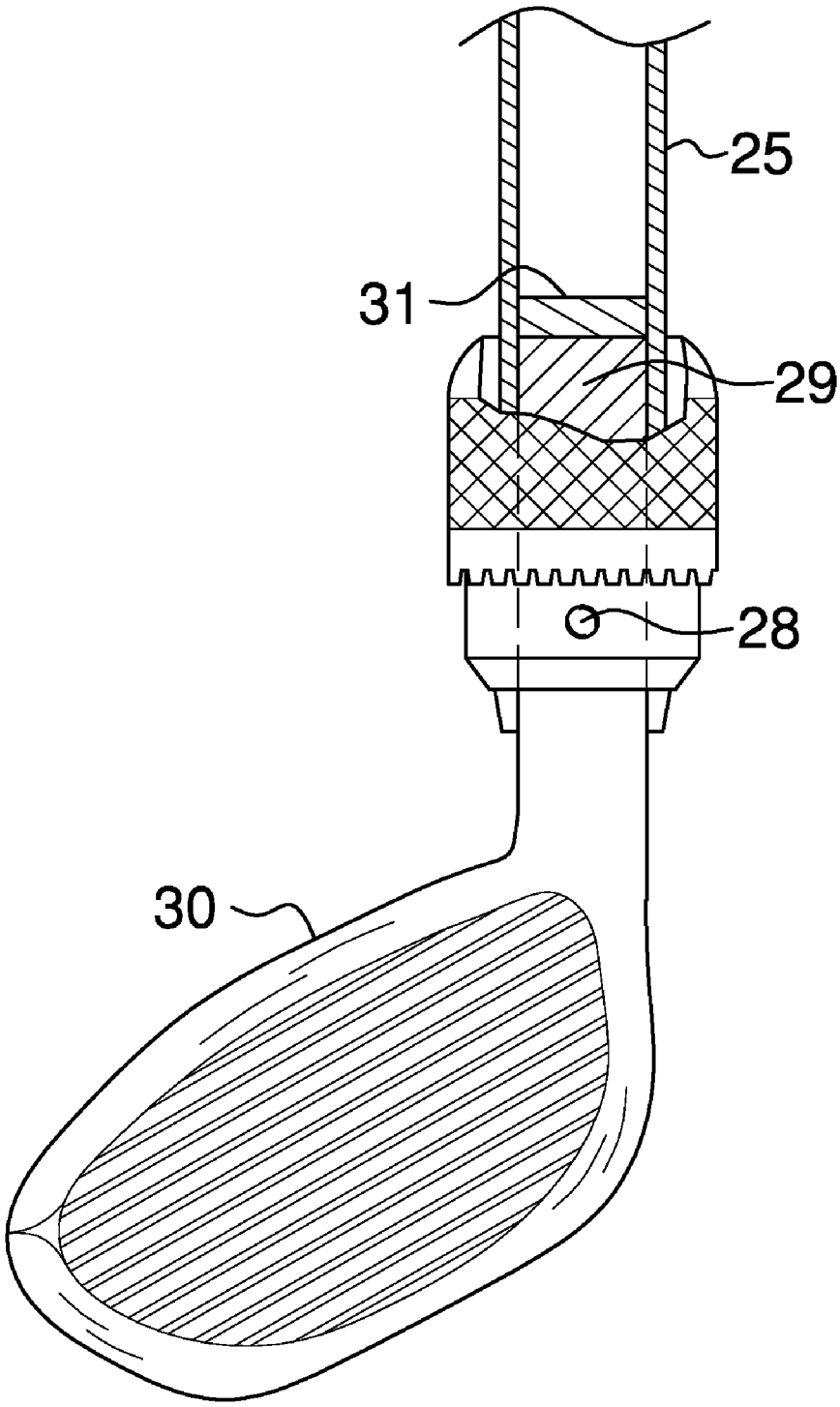
FIG. 4 is a view according to line 4-4 on FIG. 1.
Figure 5:
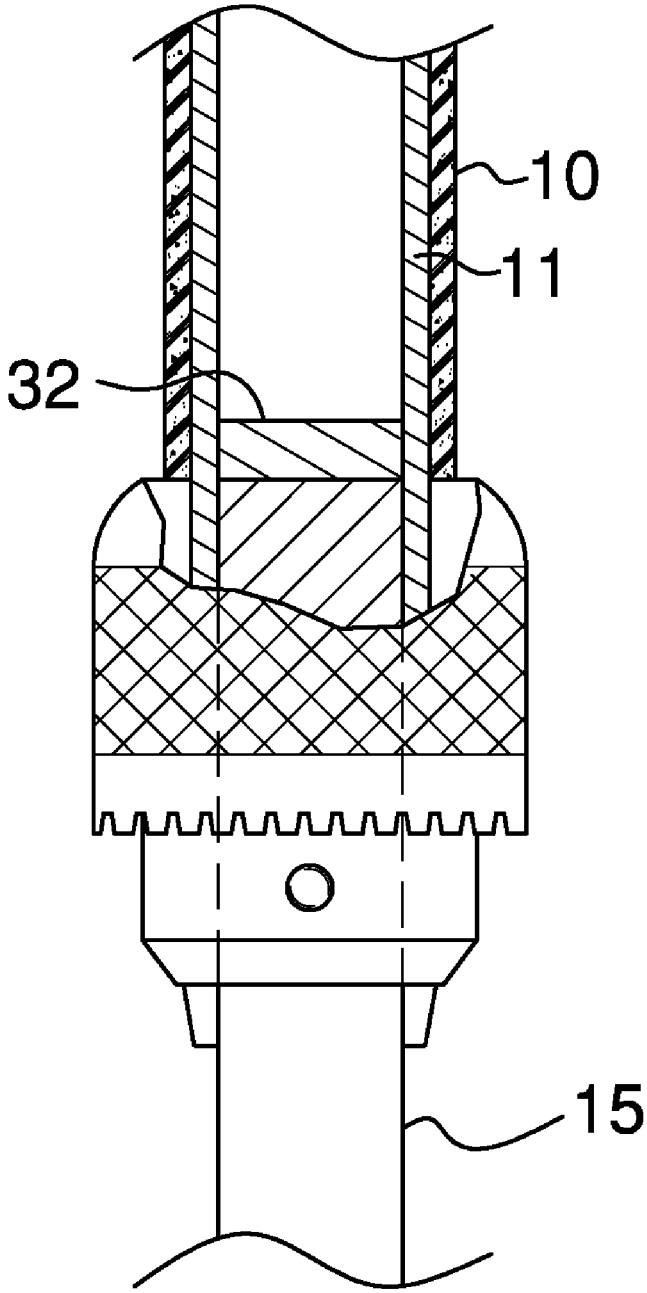
FIG. 5 is a fragmented cross-sectional view of the shaft near the grip.

An individual grips the golf club on the gripping surface 10 of the golf club at one end of the shaft. The grip or gripping surface 10 surrounds a shaft 11, which extends from one end of the grip to the other. Golf clubs are typically smooth surfaces and the grip 10 improves the ability of the golfer to handle the club. At one end of the grip is a locking ring 20. In the interior of the hollow grip shaft is a stop mechanism 32, which predetermines the amount of adjustment that may be made to the length of the club. Three locking rings are used on the device, a first locking ring near the junction of the grip 10 and the exterior upper shaft 15, a second locking ring 20 in the approximate middle of the club and a third locking ring near the junction of the exposed portion of the inner telescoping shaft 25 and the club head 30 such as depicted in FIG. 3.

An exterior outer shaft 15 extends from a connection point near one end of the grip 10 to a second locking ring 20 at the opposite end of this exterior outer shaft near the middle of the club. This second locking ring 20, which is positioned on the exterior outer shaft, allows the height or length of the golf club shaft in that portion near the grip to be adjusted. The exterior outer shaft 15 is hollow.

A portion of an inner telescoping shaft 16 is placed a predetermined amount within the hollow exterior outer shaft 15. An exposed portion of the inner telescoping shaft 25 is not placed within the hollow exterior outer shaft 15 so that the golfer can make the appropriate height adjustments for the particular club using the markings 28 for that purpose.

In operation, each of the locking rings 20, which are comprised of an outer locking shell 20A and an inner locking shell 20B, surround a set of jaws 26 which abut the surface of the respective portion of the shaft. On one surface of the locking ring 20 is a set of exterior teeth 33 which mates with a chuck key 27. The jaw 26 will have a threaded portion 26T at one end, which mates with a set of internal threads 20T on the interior surface of the outer locking shell 20A. A protuberance 40 is provided on one end of the outer locking shell 20A which mates with a groove 41 on the shaft of the club.

The outer locking shell 20A surrounds the inner locking shell 20B as depicted in FIG. 3; the inner locking shell surrounds a portion of the jaw 26 that abuts the outer surface of the shaft. A inner locking shell protuberance 43, which mates with a groove on the outer locking shell 44, is provided on one end of the inner locking shell 20B. This insures that the various parts of the locking shells remain in alignment and move as the chuck key 27 is turned and moves the jaws 26 along the shaft. The respective threaded portions mate and force the portion on the jaw that abuts the shaft to move up or down the shaft 25 of the club.

A chuck key hole 28 is provided to use the chuck key 27 to move the outer locking shell 20A. This tightening means is similar to the means that is used to tighten a drill bit in a drill. The locking ring is internally threaded to the jaws of the locking ring and a means to secure the locking ring to the shaft is provided. Because of the internal threads and because the locking ring is secured to the shaft, when the chuck key 27 is turned in a certain direction, the jaws 26 will constrict around the club surface. When the chuck key 27 is turned in the opposite direction, the jaws 26 move away from the club surface.

A spring 39 is located in the cavity of the outer locking shell 20A and is compressed as the chuck key 27 is turned in one direction or is allowed to expand as the chuck key is turned in the opposite direction.

Because the exposed portion of the inner telescoping shaft 25 will be exposed to significant amounts of force when the ball is struck, a seal 35 is placed in a notch on one end of the jaw 26 for that purpose. Many different seal materials may be used and no specific material is being claimed. Possible examples of seal materials include rubber or neoprene.

One end of the exterior outer shaft is connected to the club at one end near the grip at the position of the locking ring for that purpose and at the other at another locking ring.

An inner telescoping shaft 16, which telescopes inside the exterior outer shaft 15 allows a length adjustment of the club. Height adjustment markings 28 are provided on the exposed portion of the inner telescoping shaft 25 so that an individual can properly adjust the length of the club based on the height adjustment markings 28.

At the end of the device near the club head is another locking ring which allows the club head to be taken off and placed back on. A stop mechanism 31 which is placed within the hollow interior shaft prevents the club head from moving too much vertically. A protrusion 29 on the respective club head rests flush with one side of the stop mechanism 31 when the club head is installed. A variety of different club heads may be used with this single device.

When the device is to be used the person loosens the appropriate locking ring 20, adjusts the interior shaft relative to the height adjustment marking 28 and then locks and tightens the respective locking rings until jaws are secured to the shaft and the length of the club is appropriate. The locking rings prevents the club from swaying from side to side or bending excessively. In order to reinforce the device, cushioning material may be included in the hollow sections of the grip and exterior outer shaft.

The person places the appropriate club head on the end of the club for instance, a driver 30, a three iron 32 or a putter 34. Additionally, a separate locking ring 20 similar to the other locking rings on this device is used to change the club head 30.

Figure 6:
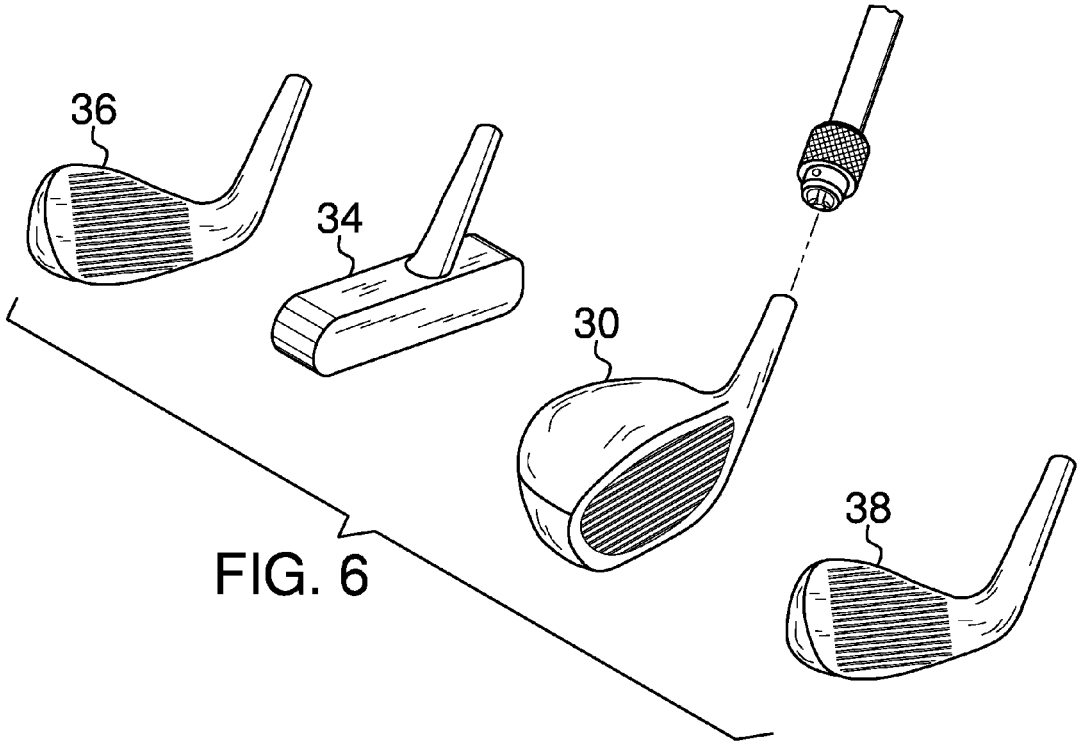
FIG. 6 is an isometric view of the various clubs that may be changed and a figure showing the mating end of the shaft.

As stated previously, this device may be used on any type of club as depicted in FIG. 6. This may include, for example, a five iron 36, a putter 34, a three wood 30 or a four iron 38.

The inventor claims:

1. An interchangeable golf club system, which is comprised of:

a. a golf club;

wherein the golf club has a first end and a second end;

wherein the first end is gripped by the individual using the club;

wherein a golf club head is positioned at the second end of the club;

b. a grip;

wherein a grip is provided on a first end of a grip shaft;

wherein a locking ring is provided on a second end of the grip shaft;

c. an exterior outer shaft;

said exterior outer shaft has a first end and a second end;

wherein the first end of the exterior outer shaft is joined to the grip;

wherein a locking ring is provided to secure said exterior outer shaft to the grip;

said exterior outer shaft is of predetermined length and is secured to an inner telescoping shaft with a locking ring at the second end of the exterior outer shaft;

wherein the exterior outer shaft is hollow;

d. the inner telescoping shaft;

wherein the inner telescoping shaft is positioned inside the exterior outer shaft;

wherein the inner telescoping shaft is allowed to telescope within the exterior outer shaft;

e. locking ring;

wherein a plurality of locking rings are provided;

said locking ring is comprised of an outer locking shell and an inner locking shell;

said outer locking shell surrounds the inner locking shell;

said inner locking shell surrounds a portion of a jaw;

wherein a protrusion is provided on one end of the outer locking shell;

wherein a groove is provided on each of the grip shaft, exterior outer shaft and the interior telescoping shaft;

said protrusion fits within the groove in each of the grip shaft, exterior outer shaft and the interior telescoping shaft;

wherein an inner locking shell protrusion is provided;

wherein a groove on one end of the outer locking shell is provided;

said inner locking shell protrusion fits within the groove on the outer locking shell;

wherein a set of threads is provided on a interior surface of the outer locking shell;

said threads on the outer locking shell mate with corresponding threads on a portion of the jaw surface;

wherein a spring is provided in a cavity of the outer locking shell;

wherein the first end of the spring abuts the top surface of the cavity of the outer locking shell and the second end of the spring abuts one end of the jaw;

wherein external teeth are provided on the locking ring;

wherein when the external teeth are rotated in a certain direction the jaw constricts around an outer surface of one of said exterior outer shaft, said interior telescoping shaft or said head;

f. jaw;

wherein a plurality of jaws are provided;

each of the grip shaft, exterior outer shaft and the interior telescoping shaft have one of the said plurality of jaws abutting;

wherein a notch is provided on one end of the jaw;

wherein the jaw has a set of threads on one end;

g. seal;

wherein a seal is provided;

wherein the seal is placed in the notch of the jaw;

h. stop mechanism;

wherein a stop mechanism is provided to limit the travel of the inner telescoping shaft;

i. golf club head;

wherein a plurality of golfing heads are utilized.

2. The interchangeable golf club system as described in claim 1 wherein cushioning material is placed in the inner telescoping shaft.

3. The interchangeable golf club system as described in claim 1 wherein a plurality of height adjustment markings are provided on the exposed portion of the inner telescoping shaft.

* * * * *